US008069787B2

(12) United States Patent
Koblinger et al.

(10) Patent No.: US 8,069,787 B2
(45) Date of Patent: Dec. 6, 2011

(54) PRINTING COUPLE, PRINTING PRESS, AND METHODS FOR OPERATING A PRINTING COUPLE

(75) Inventors: Michael Koblinger, Zellingen (DE); Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 103 days.

(21) Appl. No.: 12/733,553

(22) PCT Filed: Aug. 13, 2008

(86) PCT No.: PCT/EP2008/060643

§ 371 (c)(1),
(2), (4) Date: Mar. 8, 2010

(87) PCT Pub. No.: WO2009/033909

PCT Pub. Date: Mar. 19, 2009

(65) Prior Publication Data

US 2010/0242759 A1 Sep. 30, 2010

(30) Foreign Application Priority Data

Sep. 6, 2007 (DE) ..... 10 2007 000 944
Nov. 22, 2007 (DE) ..... 10 2007 047 842

(51) Int. Cl.
*B41F 27/12* (2006.01)
*B41F 27/06* (2006.01)

(52) U.S. Cl. ..... 101/378; 101/383; 101/415.1; 101/483

(58) Field of Classification Search ..... 101/378, 101/383, 415.1, 479, 483, 409; 271/277, 271/82; *B41F 27/12, 27/06*
See application file for complete search history.

(56) References Cited

U.S. PATENT DOCUMENTS

| | | | |
|---|---|---|---|
| 3,659,525 | A | 5/1972 | Woessner et al. |
| 6,901,858 | B2 | 6/2005 | Koppelkamm |
| 7,650,837 | B2 | 1/2010 | Schafer |
| 2008/0028965 | A1 | 2/2008 | Herbert et al. |
| 2009/0078138 | A1 | 3/2009 | Masuch et al. |
| 2009/0145315 | A1 | 6/2009 | Schafer et al. |

FOREIGN PATENT DOCUMENTS

| | | | |
|---|---|---|---|
| DE | 10244574 | A1 | 4/2004 |
| DE | 102004021606 | A1 | 12/2005 |

(Continued)

*Primary Examiner* — Ren Yan
*Assistant Examiner* — Jennifer Simmons
(74) *Attorney, Agent, or Firm* — Mattingly & Malur, P.C.

(57) ABSTRACT

A printing group of a printing press includes at least one form cylinder that has at least one axially extending opening on the external surface of the cylinder. That at least one axially extending opening forms a channel in the cylinder and in which channel several printing form end retaining assemblies are provided. These retaining assemblies are provided in the channel on both sides of a center plane which bisects the form cylinder perpendicularly to its axis of rotation. A first one of these retaining assemblies that adjoins the center plane cooperates with a second retaining assembly, located on the other side of the center plane, to both engage the same printing form, in a first mode of operation. In a second mode of operation, the first retaining assembly cooperates with a third retaining assembly, that is located further away from the center plane, and on the same side thereof as the first retaining assembly, to engage a second printing form.

34 Claims, 6 Drawing Sheets

FOREIGN PATENT DOCUMENTS

| | | | | |
|---|---|---|---|---|
| DE | 102004033920 | A1 | | 12/2005 |
| DE | 102005034331 | A1 | | 10/2006 |
| DE | 102005029167 | A1 | | 12/2006 |
| DE | 102007014323 | B3 | | 3/2008 |
| EP | 1481803 | A1 | | 12/2004 |
| GB | 284161 | | | 1/1928 |
| JP | 2003182033 | A | * | 7/2003 |
| WO | 2005108079 | A1 | | 11/2005 |
| WO | 2006136047 | A2 | | 12/2006 |
| WO | 2007099147 | A2 | | 9/2007 |

* cited by examiner

PRINTING COUPLE, PRINTING PRESS, AND METHODS FOR OPERATING A PRINTING COUPLE

CROSS-REFERENCE TO RELATED APPLICATIONS

This application is the U.S. national phase, under 35 U.S.C. 371, of PCT/EP2008/060643, filed Aug. 13, 2008; published as WO 2009/033909 A1 on Mar. 19, 2009 and claiming priority to DE 10 2007 000 944.7, filed Sep. 6, 2007 and to DE 10 2007 047 842.0, filed Nov. 22, 2007, the disclosures of which are expressly incorporated herein by reference.

FIELD OF THE INVENTION

The present invention is directed to a printing couple, to a printing press and to methods for operating a printing couple. The printing couple is comprised of at least one forme cylinder which has at least one axially extending opening on its surface. That at least one opening communicates with a cylinder channel that is provided with multiple printing forme end retaining assemblies. These printing forme end retaining assemblies are spaced axially in the cylinder channel.

BACKGROUND OF THE INVENTION

DE 10 2005 034 331 A1 discloses a printing press which, in one mode of operation, prints a web with five printed pages of a first format side by side. In other modes of operation, this printing press prints that web with three or four pages of other formats.

DE 102 44 574 A1 discloses individually actuable actuating assemblies for use in operating retaining elements which are arranged side by side. The number of these actuating assemblies corresponds to the number of possible printed image sections. The actuating assemblies receive pressure medium via a first shared section of a supply line and via controllable valves which are assigned to the respective actuating assemblies and separate second sections of supply line. The valves and the second line sections are assigned to the cylinder and can be controlled from outside the cylinder.

DE 10 2004 021 606 A1 discloses an embodiment of a forme cylinder with four printing formes arranged side by side and on the outer surface of the forme cylinder and in the axial direction of the forme cylinder. In other embodiments of the forme cylinder, two, three, five, six, seven or eight printing plates can also be arranged side by side. Each printing plate is provided with a clamp and also with an individually controllable delivery hose segment.

In the flexible printing plate clamping device described in U.S. Pat. No. 3,659,525 A, retaining elements for plate ends are provided in a channel of the forme cylinder. These elements work together with printing plates of different widths and arrangements in different operating modes. In this case, the leading ends of the printing plates are inserted between support plates for the respective retaining element and to which leaf springs are attached. The plate ends are thereby held in place by clamping force, without being clamped there expressly via an actuating assembly. The retaining elements are arranged on shafts, which are capable of pivoting slightly in the circumferential direction in order to adjust the circumferential register. In this case, a shaft piece, which is arranged adjoining the cylinder center, and to one side thereof, can alternatively be non-rotatably connected to the left or the right shaft piece, which are actuable by the use of a right or a left actuating mechanism, respectively.

SUMMARY OF THE INVENTION

The object of the present invention is to provide a printing couple, a printing press and methods for operating a such printing couple which will provide the operator with a large measure of product versatility at low cost.

The object of the present invention is attained, according to the present invention, with the provision of at least the one forme cylinder of a printing couple of the printing press being provided with at least one axially extending opening into a channel. A plurality of printing forme end retaining assemblies are arranged, spaced axially from each other, in the forme cylinder channel. Ones of these retaining assemblies are located on both sides of a center plane which bisects the forme cylinder perpendicular to its axis of rotation. These retaining assemblies are selectively usable with other retaining assemblies that are located on either side of the cylinder center plane.

The benefits to be achieved in accordance with the present invention consist, in particular, in that the embodiment of the printing couple, and especially of the forme and/or transfer cylinder, allows for the production of products that are fundamentally different from one another in the same printing press. Such a production of various fundamentally different printing products can be accomplished without great expense.

The forme cylinder channel that is continuous lengthwise and/or the divided configuration of the plate locking mechanism of the center cylinder section allow either uneven numbers of printing formes, or alternatively, even numbers of printing formes to be mounted on the forme cylinder, arranged side by side, and/or to allow printed pages to be printed side by side on the web. Also advantageous, in this regard, is the use of a printing blanket on the transfer cylinder, which printing blanket is continuous over its entire length. In one embodiment of the present invention, in which an uneven number of printing formes are arranged side by side on the forme cylinder, each forme has two print images side by side and are thus panoramic printing formes. It is also advantageous to arrange two rubber blankets side by side on the transfer cylinder and with each blanket extending over half the surface length of the cylinder. In one operating mode having an even number of printing formes, such as, for example, two printing formes or having an even number of print images, such as, for example, four, six, eight or ten such images arranged side by side lengthwise, it is advantageous, in terms of variable page widths to arrange the print images on printing formes that each extend halfway across the length of the cylinder. In other words, it is beneficial to arrange the print images on two printing formes that are positioned side by side.

It is especially advantageous, in accordance with the present invention, for retaining assemblies of a center longitudinal one of multiple longitudinal sections of a forme cylinder, to be assignable to groups of retaining assemblies of adjoining sections. These various groups are preferably different from one another with respect to their activation.

The capability for processing variable page widths and/or various page numbers, in accordance with the present invention, can further be advantageously provided by the inclusion of a longitudinal cutting device with movable blades and/or by the provision of a turning device with movable turner bars and/or of a former assembly with a movable fold former.

Because of the need, for example, to either alternatively or simultaneously run newspaper and journal or magazine production, the embodiment of the printing press and/or of the printing units and/or printing couple cylinders is advantageous in its individual features or advantageously also in combinations of multiple features, as will be specified below.

BRIEF DESCRIPTION OF THE DRAWINGS

Preferred embodiments of the present invention are represented in the set of drawings and will be specified in greater detail in what follows.

The drawings show.

DESCRIPTION OF THE PREFERRED EMBODIMENTS

Figure 1:
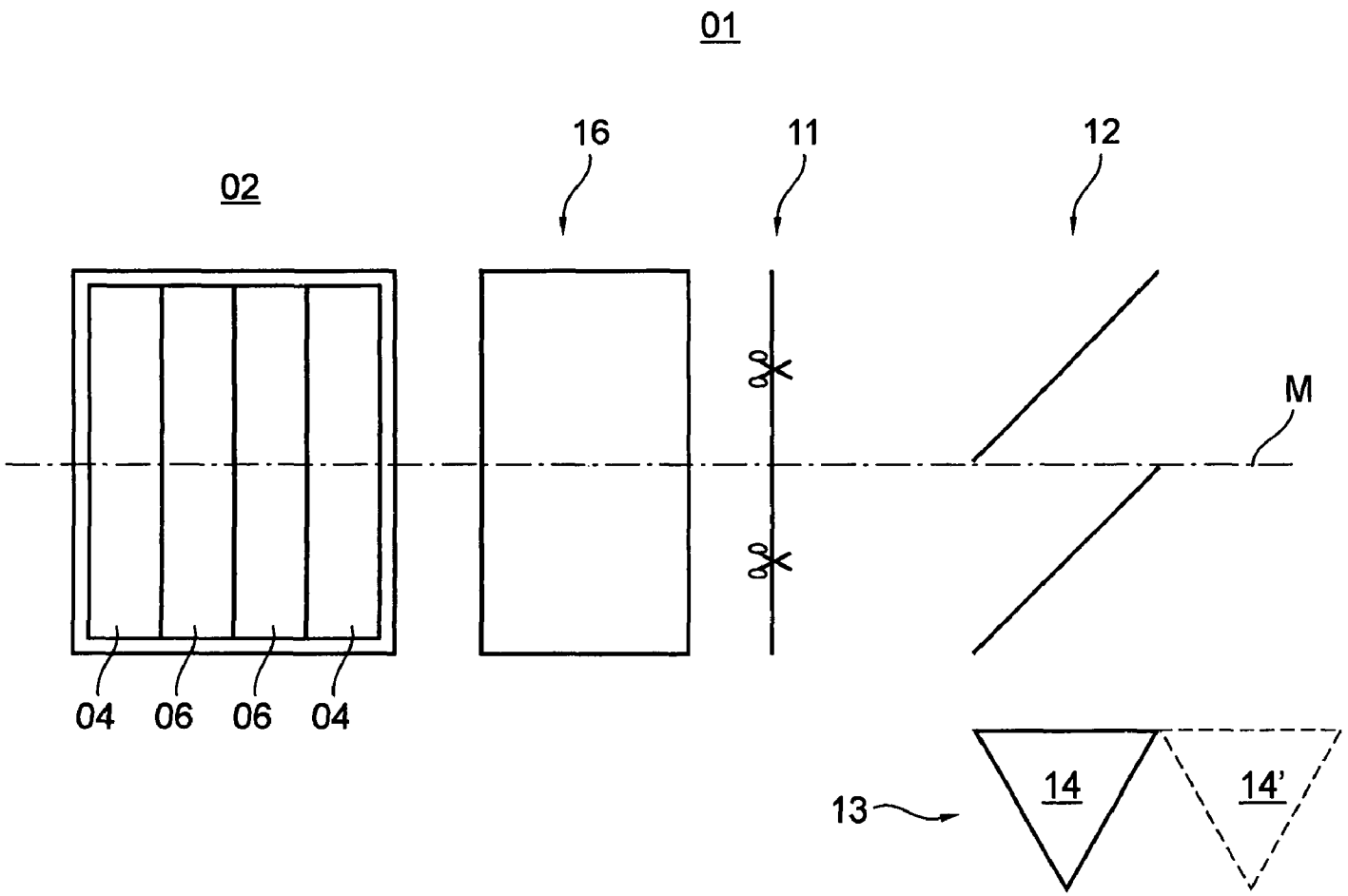
FIG. 1 an schematic depiction of an embodiment of a printing press line.

Referring initially to FIG. 1, there may be seen a schematic depiction of a printing press, and especially of a web-fed rotary printing press. This printing press has at least one printing press line 01 which is comprising of at least one printing unit 02, and advantageously is comprised of a group of multiple printing units 02, and especially at least two printing units, preferably located adjacent to one another. The printing units 02 of the printing press line 01, which may be embodied as printing towers 02, for example, are arranged in alignment along a press center plane M, which is oriented perpendicular to the rotational axes of the printing couple cylinders 04; 06. The printing units 02 here are preferably embodied as printing towers 02 with an essentially vertical web lead. These printing towers preferably each have a least eight print positions, especially each have four blanket-to-blanket print positions. The printing units 02 each have at least two printing couple cylinders 04 which are embodied as forme cylinders 04. In the present invention, which is involving offset printing units, a printing couple cylinder 06, which is embodied as a transfer cylinder 06, is assigned to each forme cylinder 04. Advantageously, for example with respect to register error and/or to provide a compact structure, the printing couples of the printing unit(s) 02 can be embodied as printing couples for waterless offset printing. They thus may be configured without dampening units.

Figure 2:
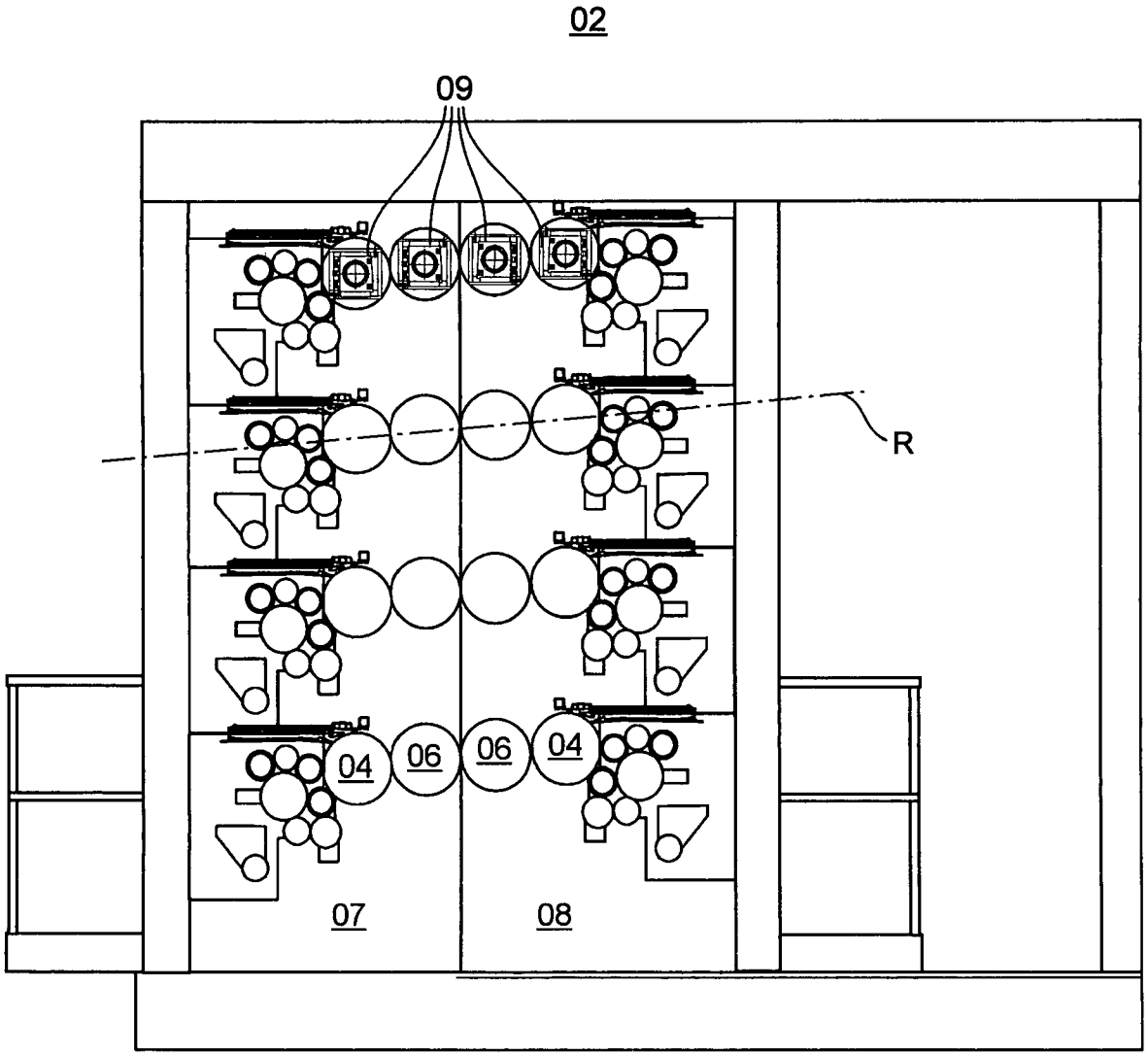
FIG. 2 a side elevation view of an embodiment of a printing unit.

FIG. 2 shows a preferred embodiment of a printing unit 02 in accordance with the present invention. Printing unit 02 is provided having eight print positions or having four blanket-to-blanket print positions, one above the other, with a vertical web lead. In the print-on position, the four printing couple cylinders 04; 06 of each blanket-to-blanket printing couple are preferably arranged in relation to one another such that the planes between the rotational axes of the cooperating forme and transfer cylinders preferably deviate at a maximum of 15°, and advantageously deviate a maximum of 7°. Preferably, these planes deviate not at all, from a plane R that connects the rotational axes of the two transfer cylinders 06. In this way, the most linear possible arrangement of the four printing couple cylinders 04; 06 is provided.

In a further improvement of the present invention, which improvement is advantageous in terms of a compact structure, the printing unit 02 is embodied to be separable with respect to its side frames. The printing couple cylinders 04; 06 of the multiple, such as, for example, four blanket-to-blanket printing couples, which are arranged one above the other, are rotatably mounted, for example, in or on one right and one left frame or panel section 08; 07 in such a way that the two printing couple cylinders 04; 06 of one printing couple are assigned to the same frame or panel section 07; 08. Preferably, the printing couple cylinders 04; 06 of multiple, and especially of all of the printing couples that print the web, such as, for example, the web of print substrate or paper, on the same side of that web are mounted on the same frame or panel section 07; 08. The partial printing units are movable toward or away from one another in a direction perpendicular to the rotational axis of the printing couple cylinders 04; 06. Preferably, one of the two panel or frame sections, such as section 08 is stationary and the other of the two panel or frame sections, such as section 07, is mounted so as to be movable in relation to the floor.

As is also shown in FIG. 2, in an advantageous further improvement, the journal bearings of the printing couple cylinders 04; 06 are mounted so as to be controllable in linear bearing units 09, such as, for example, in linear bearings 09. Especially advantageously, actuators that can be pressurized with pressure medium, and in particular, actuators which can be pressurized alternatively at two different selectable pressure levels, are provided as actuating assemblies for engaging and disengaging the printing couple cylinders 04; 06. The direction of adjustment in the linear bearings 09, or in the linear bearing units 09, preferably extends parallel to the plane R that connects the transfer cylinders 06, or is inclined in relation to this plane by a maximum of 15°, especially by a maximum of 10°.

The printing press line 01, as may be seen in the schematic depiction of FIG. 1, also has a longitudinal cutting device 11 downstream of the printing unit 02. Such a longitudinal cutting device can be provided, for example, with a number I of blades that are each movable crosswise to the direction of travel of the web. The printing press line can also include a turning device 12 with one or more turner bars, and a former assembly 13. The former assembly 13 is preferably oriented such that a direction of web feed to the fold former or fold formers 14; 14', when projected horizontally, extends perpendicular to the center plane M of the press. The former assembly 13 is thus offset 90° from the press center plane M. A folder, which is not specifically shown here, is also situated downstream of the former assembly 13. Preferably, a dryer 16 is situated downstream of the printing unit 02. The web alternatively passes through the dryer 16 in at least one of the modes of operation which will be specified below. Guiding assemblies may also be provided and which will allow the dryer 16 to be circumvented in at least one operating mode.

In one embodiment, the former assembly 13 has a former plane with two fold formers 14; 14' which are arranged side by side, as depicted schematically in FIG. 1. These formers 14, 14' can advantageously be embodied as being adjustable with respect to a horizontal distance between their noses.

The turning device 12 preferably has at least two turner bars for each printing unit 02 of the printing press line 01. Advantageously, the turner bars can be embodied as being movable along the press center plane M and/or as being movable crosswise with respect to the press center plane M. This capacity for movability of the turning bars enables their alignment with the fold former or fold formers 14; 14' in cases of varying partial web width and/or partial web length.

The printing unit or units 02 and the printing couples and printing couple cylinders 04; 06, respectively, are dimensioned such that their length L, as seen in FIGS. 3*a*) and 3*b*), is at least that of the usable surface of the forme cylinder 04, which forme cylinder 04 is embodied in the axial direction having N sections A; B; C; D; E, as depicted in FIG. 4, with N being equal to three, five or seven. These sections are intended for holding the uneven number N of first printing formes 17; 17', which are arranged side by side and which particularly having the same width B17, at least in a first operating mode I, as seen in FIG. 3*a*) and FIG. 5*a*). In other words, a usable surface length L of the forme cylinder 04 corresponds essentially to the uneven number N of sections A; B; C; D; E or printing formes 17; 17'. Preferably, at least (N+1) *B17>L≧N*B17. In a first operating mode I, the forme cylinder 04 thus has an uneven number of precisely N printing formes, which are side by side in the longitudinal direction of the forme cylinder 04. In principle, each of these N first printing formes 17; 17', referred to as printing formes 17; 17' of the first type, can have only one printed page of a first format F1; f1, and is a single printing forme 17, as seen in FIG. 3*a*) and in FIG. 4 or can have multiple, and especially two, printed pages of the first format F1; f1, such as, for example, panoramic printing forme 17' side by side, as seen in FIG. 5 and FIG. 6, as viewed in the axial direction of the forme cylinder 04.

The first format F1; f1 can be embodied as vertical printed pages in a broadsheet format, such as shown in format F1, and preferably in newspaper format F1, and especially newspaper pages. The first format can be embodied as horizontal printed pages in a tabloid format, format f1, as seen in FIG. 3*a*) and in FIG. 5*a*).

The forme cylinder 04 thus has an uneven number N of sections A; B; C; D; E in the longitudinal direction. Each such section, for example in a first operating mode, can be covered with one printing forme 17; 17'.

The forme cylinder 04, has on its outer surface, at least one opening 19 to a channel 20, which channel 20 extends radially into the interior of the forme cylinder 04, and into which opening 19 the angled ends of the printing formes 17; 17', or 18; 18', as will be discussed below, can be inserted for fastening. The at least one opening 19 is preferably formed as being continuous and as extending over the usable length L and/or over the width of the N sections A; B; C; D; E.

In the channel 20, which is preferably a continuous channel 20, at least one retaining assembly 22, or a group of retaining assemblies is provided for each section A; B; C; D; E of the forme cylinder 04.

At least in the center section of the uneven number N of the plurality of forme cylinder sections A; B; C; D; E, at least two such retaining assemblies 22 are provided. At least one of these at least two retaining assemblies 22 is located on each side of a center plane H. That center plane H bisects the forme cylinder 04 perpendicular to its axis of rotation as seen in FIG. 4. Each such retaining assembly 22 can be actuated independently of another such retaining assembly 22 via respectively assigned actuating device 21.3*a* for retaining assembly 22.*a*; or actuating device 21.3*b* for retaining assembly 22.*b*. Each such retaining assembly 22.*a*, 22.*b* can be assigned alternatively, through circuitry, either with the adjoining actuating devices 21.3*b*; 21. 3*a* on the one side in the same channel to a group I-3 to be controlled as a unit in a first operating mode I, or can be assigned with the adjoining actuating device 21.2 or 21.4 on the other side in the same channel to another group II-1; II-2 to be controlled as a unit in a second operating mode II. In the depiction of FIG. 6, the actuating devices 21.3*b*; 21.3*a* can be assigned to either the actuating devices for 21.1 or 21.5.

Preferably, and with the exception of the retaining assemblies 22.*a*; 22.*b* 22 of the center section of the uneven number N of sections A; B; C; D; E of the forme cylinder, the retaining assemblies 22 for each of the other sections can be actuated individually via actuating devices 21.1; 21.2; 21.4; 21.5. If multiple retaining assemblies 22 are provided for each section A; B; C; D; E, these multiple retaining assemblies for each section can be actuated together as a group I-1; I-2; I-4, I-5 of the relevant section A; B; C; D; E, via actuating devices 21.1; 21.2; 21.4; 21.5, respectively.

In a second operating mode II as depicted in FIGS. 3*b*) and 5*b*), the forme cylinder 04 has an even number of second printing formes 18; 18', referred to hereinafter as printing formes 18; 18' of the second type, such as, for example, 2, 4, six or eight, printing formes but especially two such printing formes which are situated side by side in the longitudinal direction. The even number of second printing formes 18; 18' extends essentially over the entire usable length L of the forme cylinder 04, and especially over the same width of the N sections A; B; C; D; E from the first operating mode I. The second printing formes 18; 18', which are arranged side by side, preferably all have the same width B18. The width B18 of second printing formes 18; 18' is different from the width B17 of the first printing formes 17; 17'. On each of the second printing formes 18; 18', one or more printed pages, such as, for example, three, four, five or six such printed pages, but especially, for example, four, vertical printed pages or three horizontal printed pages in a format F2 that is smaller than the newspaper format (F1), such as, for example, a magazine format F2, can be arranged side by side longitudinally along the cylinder.

In a first operating mode I, an actuating device 21.3*a* of the center section C, which actuating device 31.3*a* adjoins the plane H on a first side thereof, works together with the actuating device 21.3*b* of the section C, which actuating device 21.3*b* adjoins the plane H on the other side thereof, to cooperate with a same first printing forme 17; 17' via the two retaining assemblies 22.*a*; 22.*b*, which are allocated to section C. In a second operating mode II, the actuating device 21.3*a* works together with an actuating device 21.2 of FIG. 4 or 21.1, FIG. 6, of an adjoining section B in FIG. 4 or A, in FIG. 6, which actuating device 21.2 or 21.1 lies farther toward the outside of the forme cylinder 04 and on the same side of the plane H as the actuating device 21.3*a*, to cooperate with a second printing forme 18; 18' via allocated retaining assemblies 22.*a*; 22. The two retaining assemblies 22.*a*; 22 and/or the two actuating devices 21.3*a*; 21.3*b* cooperate, in the first operating mode I with a same first printing forme 17; 17'. In the second operating mode II, the two retaining assemblies 22.*a*; 22 and/or the two actuating devices 21.3*a*; 21.3*b* cooperate with two different second printing formes 18; 18'. If no actively actuable actuating devices are assigned to the retaining assembly 22.*a*; 22.*b*; 22, and instead only clamping mechanisms, which are based, for example, on spring force, and/or only auxiliary devices for releasing a clamping or a hooking attachment are assigned, the retaining assemblies 22.*a*; 22 cooperate in the first operating mode I with a same first printing forme 17; 17' and in the second operating mode II they cooperate with two different second printing formes 18; 18'. Optionally provided devices for release are viewed with respect to their actuation in a manner comparable to actuation of the actuating devices by assignment in groups.

Figure 3:
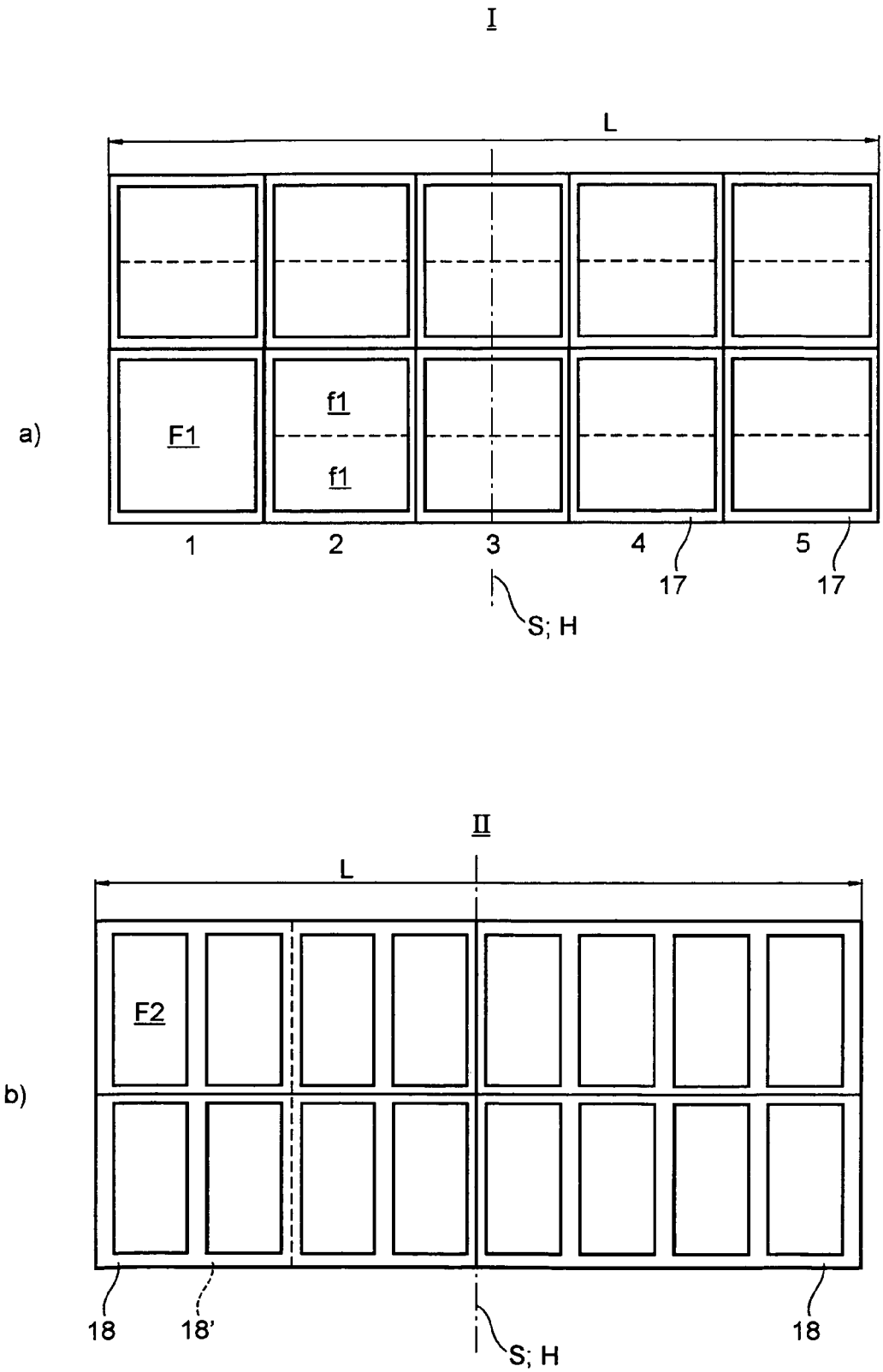
FIG. 3*a*) examples of a printing forme configuration of an uneven number of printing formes and printed pages of a first newspaper or tabloid format arranged side by side.
FIG. 3*b*) an even number of printing formes and printed pages of a second format arranged side by side.
Figure 4:
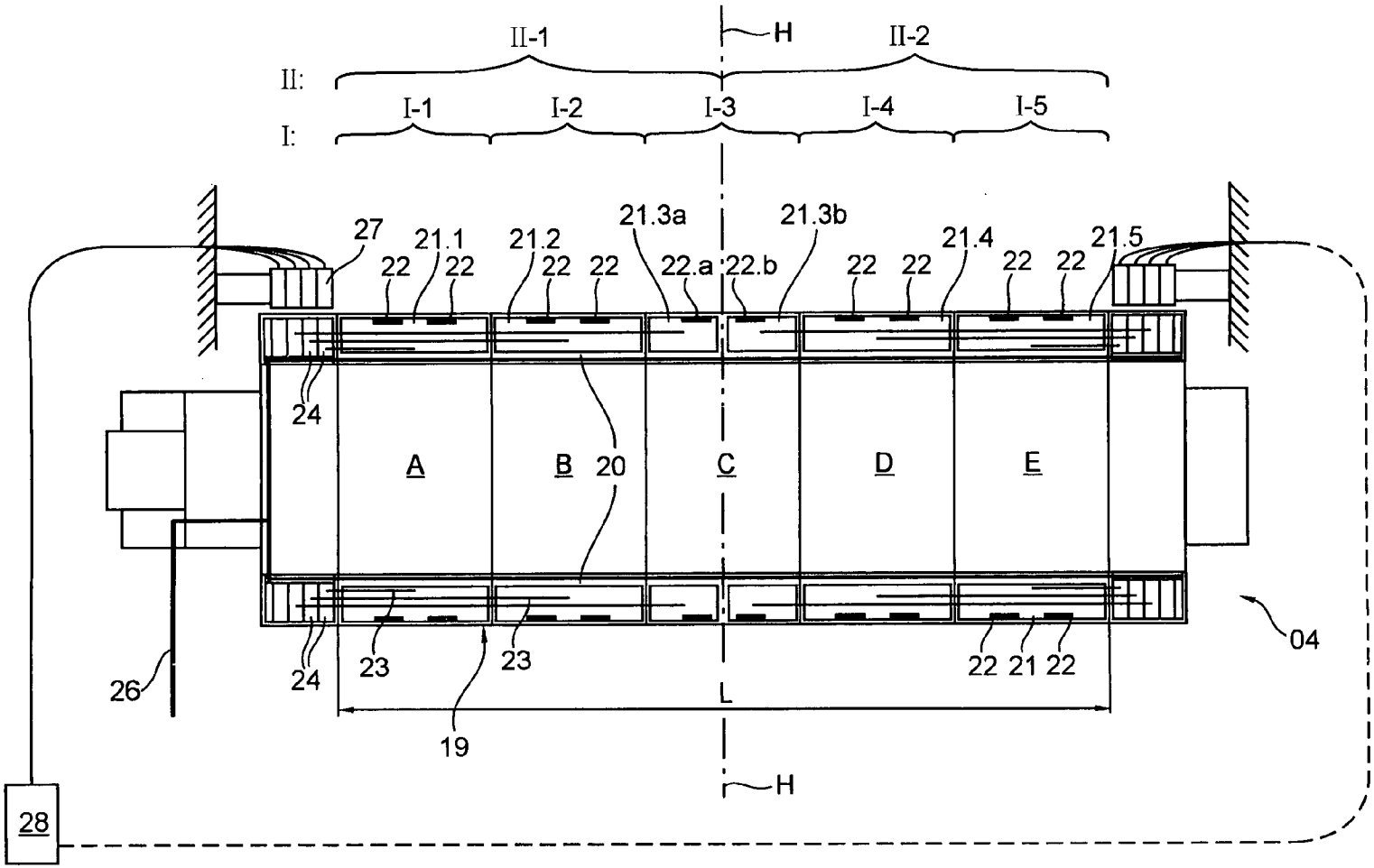
FIG. 4 a schematic representation of a first preferred embodiment of a forme cylinder with a retaining device.
Figure 5:
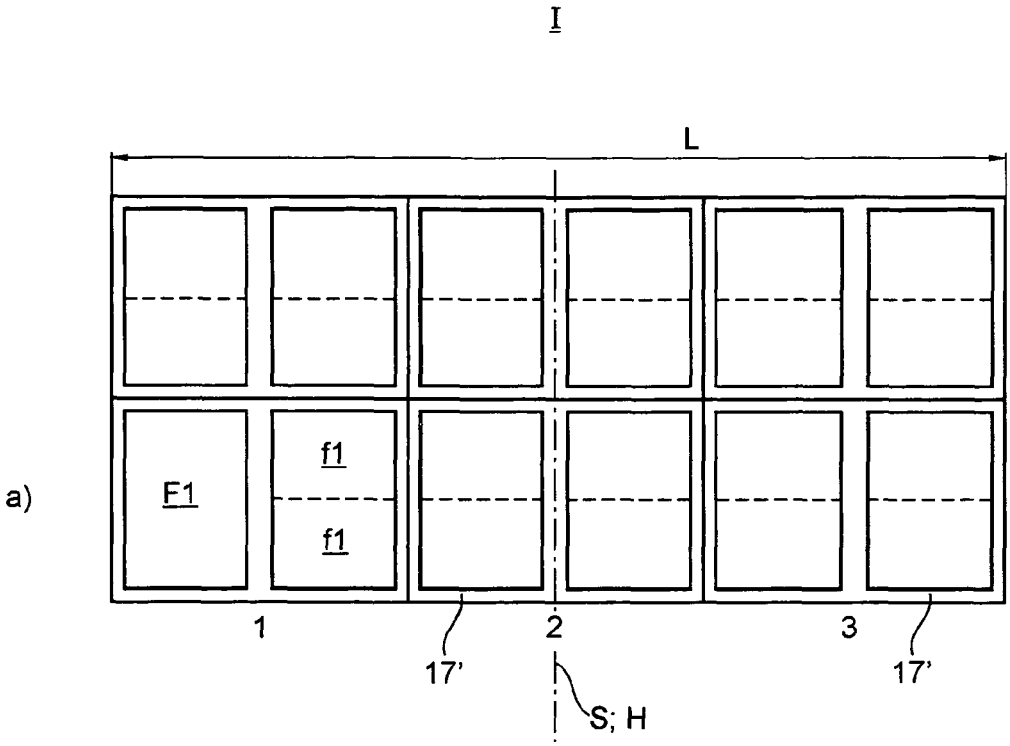
FIG. 5*a*) examples of a printing forme configuration of an uneven number of printing formes of a first newspaper or tabloid format arranged side by side.
FIG. 5*b*) of an even number of printing formes of a second format arranged side by side.
Figure 5:
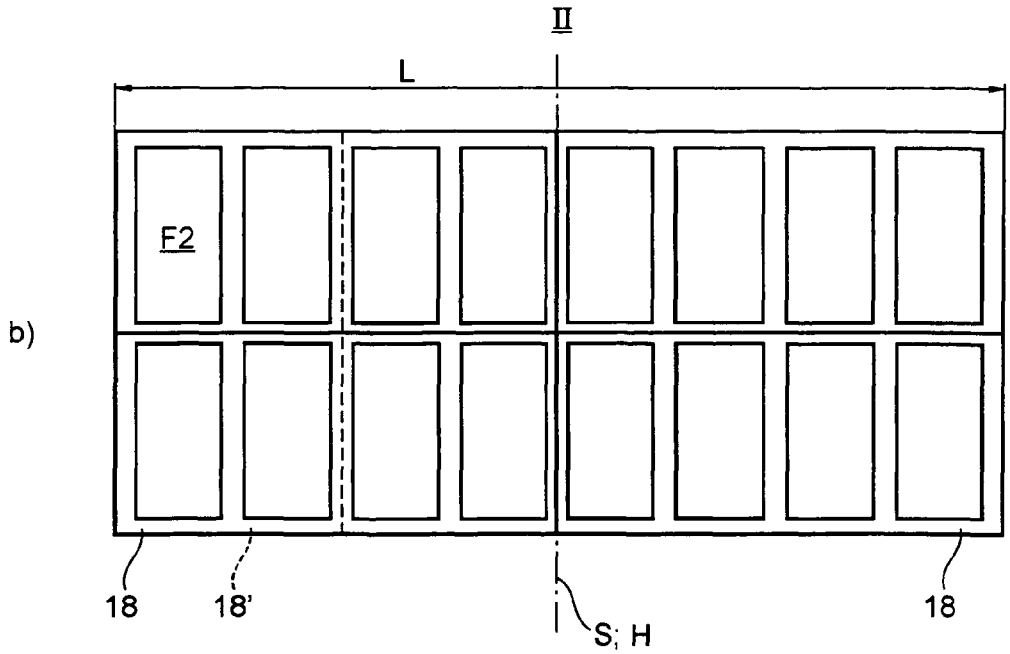
Figure 6:
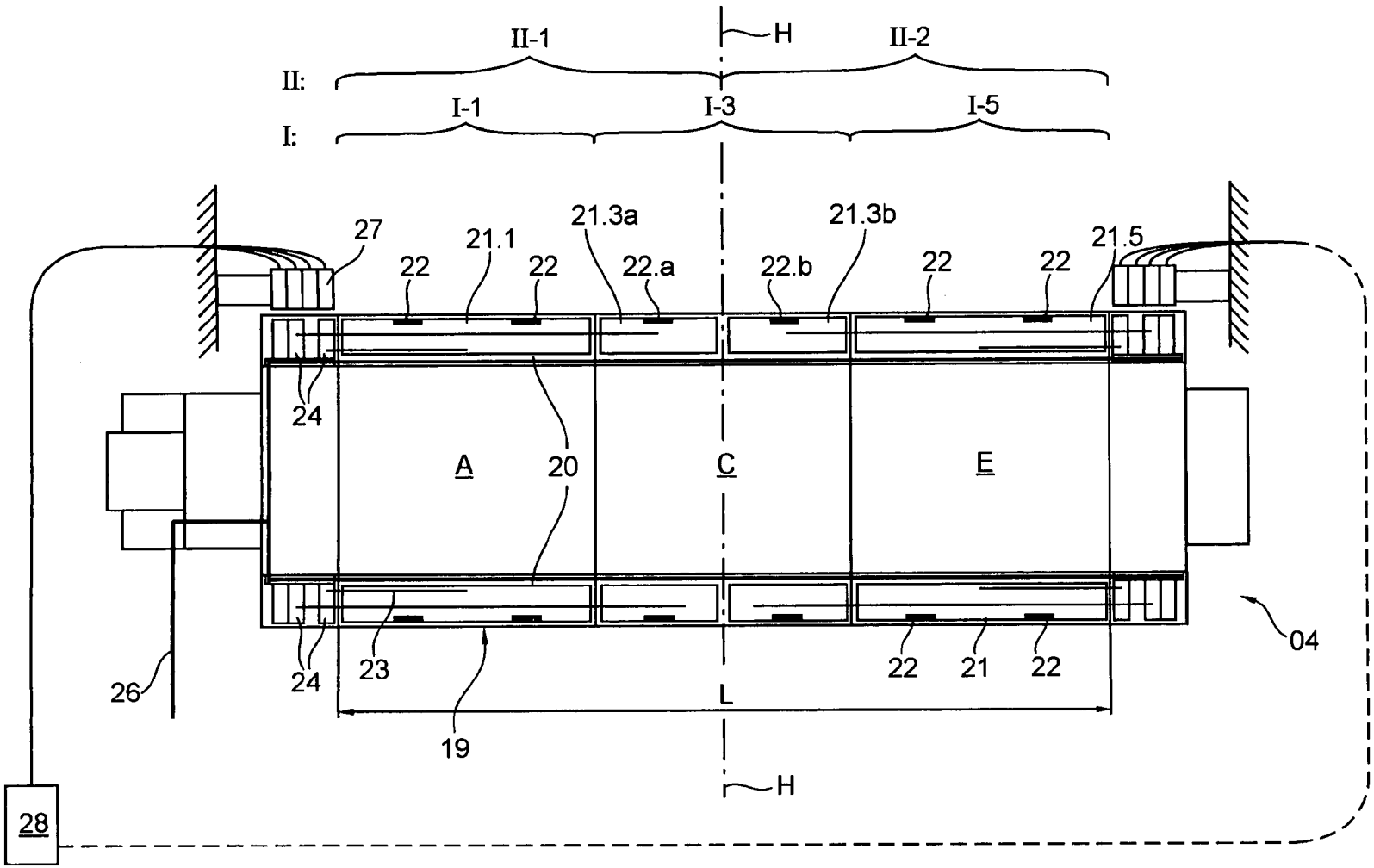
FIG. 6 a schematic representation of a second preferred embodiment of a forme cylinder with a retaining device.

In the discussion which follows, a first example, in FIG. 3 and FIG. 4, and a second example, in FIG. 5 and FIG. 6 of an uneven number N of sections A; B; C; D; E and/or of printing formes 17; 17' in a first operating mode I will be described.

In the example of FIG. 3*a*) and FIG. 4, the sections A; B; C; D; E, or the N printing formes 17, arranged side by side in one operating mode I each have the width B17 of only one printed page F1; f1. The N printing formes 17, which are arranged in this operating mode I, each support only one printed page of the first format F1, f1, as viewed in the longitudinal direction of the cylinder. In this case, an uneven number N of printing formes 17 or printed pages, such as, for example, vertical printed pages of the first format F1; f1, and arranged side by side, preferably corresponds to the number N of sections A; B; C; D; E on the forme cylinder 04 in the first operating mode I, in other words n=N, with n being equal to three, five, or seven, for example, but especially five.

In this case, the printing unit or units 02 and the printing couples and printing couple cylinders 04; 06, respectively, are dimensioned, concurrently with the aforementioned. Their length L is at least that of the usable surface of the forme cylinder 04, which is embodied in the axial direction, for example, to hold an uneven number n of vertical printed pages of a broadsheet format, such as format F1, especially newspaper format F1, and more especially, newspaper pages, arranged side by side, or n horizontal printed pages of a tabloid format, such as format f1, as shown in FIG. 3, with n being equal to three, five, or seven, for example, but especially five. In other words, the length of the usable surface of the forme cylinder 04 corresponds essentially to the width b of the n printed pages in the horizontal format f1 or the vertical format F1 arranged side by side. Preferably, at least $(n+1)*b>L\geqq n*b$.

In a first operating mode of the first example I, the forme cylinder 04 supports the printed images of n, such as, for example, five vertical newspaper pages or n, such as, for example five, horizontal tabloid pages, longitudinally on its outer surface. The forme cylinder 04 then supports, for example, two vertical newspaper pages, in a format F1, or four horizontal tabloid pages, in a format f1, one in front of the other in the circumferential direction. The usable length L, i.e., the maximum usable surface length L for printing, is 1,700 to 2,100 mm, for example, advantageously is 1,800 to 2,000 mm, and particularly is 1,825 to 1,900 mm, and most preferably is approximately 1,875 mm±10 mm. The same applies, for example, to the width of a transfer cylinder 06 that cooperates with the forme cylinder 04.

In this first operating mode or manner I of the first example, the uneven number n, such as, for example, five, of printing formes 17 having a single page width, for example single printing formes 17, are arranged on the forme cylinder 04, side by side in the longitudinal direction. Correspondingly configured retaining channels can also enable alternative use of panoramic printing formes that are two printed pages in width for the pair of printed pages near each end surface. In the circumferential direction, as shown in FIG. 3*a*, two printing formes 17, each having one vertical newspaper page or two horizontal tabloid pages, one in front of the other, can be provided, one in front of the other. However, in a special embodiment, which is not specifically shown, only one printing forme that extends nearly around the circumference, and containing two vertical newspaper pages or four horizontal tabloid pages, one in front of the other, can be provided.

In the example of FIG. 5 and FIG. 6, the sections A; C; E, which are shown in FIG. 6 or the N printing formes 17' arranged side by side in one operating mode I each have a width B17' of multiple printed pages, and especially of two such printed pages of the first format F1; f1 arranged side by side. Alternatively, the N printing formes 17' arranged in the first operating mode I each support multiple printed pages, and especially two of such printed pages of the first format F1, f1 side by side, as viewed in the longitudinal direction of the cylinder. In this case, an uneven number N of printing formes 17' arranged side by side in the first operating mode I, each with two vertical printed pages of the first format F1; f1, for example, again corresponds to the number N of sections A; C; E on the forme cylinder 04, in this case with N=3. The number n' of printed pages of the first format F1; f1 arranged side by side on the forme cylinder 04 in the first operating mode I in this case is an even number, and in this case results in n'=2*N, for example, i.e., n being equal to four, six or eight, for example, but especially six.

In the case of the second example, the printing unit or units 02 and the printing couples and the printing couple cylinders 04; 06, respectively, are dimensioned, concurrently with the aforementioned, such that their length L is at least that of the usable surface of the forme cylinder 04, which forme cylinder 04 is embodied, in the axial direction, for example, to hold an even number n' of vertical printed pages in a broadsheet format, such as format F1, or newspaper format F1, and especially newspaper pages, arranged side by side, or n' horizontal printed pages in a tabloid format, format f1, as seen in FIG. 5*a*, with n' being equal to four, six or eight, for example, but especially to six. In other words, the length of the usable surface of the forme cylinder 04, L, corresponds essentially to the sum of the widths b of the n' printed pages of the tabloid format f1 or the vertical format F1 arranged side by side. Preferably, at least $(n'+1)*b>L\geqq n'*b$.

In a first operating mode of the second example, the forme cylinder 04 supports, on its outer surface, the printed images of n', for example six, vertical newspaper pages, or n', for example six, horizontal tabloid pages, side by side in the longitudinal direction, on a total of N, such as, for example, N=3 printing formes 17' that are two pages in width, side by side. The forme cylinder 04 then supports two vertical newspaper pages, in format F1, or four horizontal tabloid pages in format f1, for example, one in front of the other in the circumferential direction. The usable length L, i.e., the maximum usable surface length L for printing, in this case is also at least 1,700 mm, for example, advantageously is 1,800 to 2,500 mm, and especially is 1,900 to 2,440 mm (each ±10 mm). The same applies, for example, to the width of a transfer cylinder 06 that cooperates with the forme cylinder 04.

In this first operating mode or manner I of the second example, the uneven number N, for example three, of printing formes 17', such as, for example, panoramic printing formes 17' that are two pages in width, are arranged on the forme cylinder 04, side by side in the longitudinal direction. In the circumferential direction, two printing formes 17', each having one vertical newspaper page or two horizontal tabloid pages, one in front of the other in the circumferential direction, can be provided, one in front of the other, as shown in FIG. 5*a*. However, in a special embodiment which is not specifically shown, only one printing forme, and containing two vertical newspaper pages or four horizontal tabloid pages, one in front of the other, that extends nearly around the circumference of the forme cylinder 04, can be provided.

With the configuration in the first mode of operation I having the uneven number N of printing formes 17; 17' side by side, as seen in FIG. 3*a* and in FIG. 5*a*, or of n printed pages side by side in the longitudinal direction, as shown in FIG. 3*a*, the center printing forme 17; 17' depicted in FIG. 3*a* and in FIG. 5*a* or the center printed page or single printing forme 17, shown in FIG. 3*a*, respectively, is arranged on the forme cylinder 04 in such a way that a center plane H that bisects the forme cylinder 04 perpendicular to its axis of rotation axis, for example approximately at its center, extends through the printing forme 17; 17', seen in FIG. 3*a* and in FIG. 5*a*, or the print image depicted in FIG. 3*a*.

In the first mode of operation I, the printing couple or the printing unit 02 is preferably operated with coldset inks. The printed web either circumvents the dryer 16 that can optionally be provided in the web path, or passes through that dryer 16, during which passage, the dryer is inactive.

In the second operating mode or manner II, shown in FIG. 3*b* and in FIG. 5*b*, the forme cylinder 04 supports an even number of printing formes 18; 18', each of multiple pages in width, side by side in the longitudinal direction on its surface, with this even number being equal to two, four, or six, for example, but especially to two.

In this case, the forme cylinder 04 preferably supports the print images of an even number m of vertical printed pages in a format F2 that is smaller than the newspaper format F1, such as, for example, a magazine format F2 or a smaller tabloid format F2 or a book format F2, side by side on its surface in the longitudinal direction, with the even number m being equal to six, eight, or ten, for example, but especially to eight, for example. In this second operating mode II, only two printing formes 18, for example, each of m/2 pages in width, for example four pages in width, are arranged on the forme cylinder 04 side by side in the longitudinal direction. The option of employing correspondingly embodied clamping channels, in order to insert a number m/2 of printing formes 18' of this second format F2 that are two pages in width, side by side, may also be provided. In the circumferential direction, two printing formes 18; 18', each containing one vertical magazine page or two horizontal magazine pages in the circumferential direction, for example, and arranged one in front of the other, can be provided. However, in a special embodiment, only one printing forme 18; 18', containing two vertical or four horizontal pages of the second format F2, one in front of the other, with this forme extending nearly around the forme cylinder circumference, can also be provided. In this case, it can advantageously be provided that in this second operating mode II, one of two openings 19, which are located, one in front of the other on the outer surface of the forme cylinder 04, is covered by the printing forme 18; 18', which extends around nearly the entire circumference of the forme cylinder.

In the second operating mode II, the printing couple or the printing couples of the printing units 02 is or are preferably operated using heatset inks. The printed web then preferably passes through the dryer 16 that can be provided in the web path.

Thus, in the first operating mode I, which may be, for example, coldest printing, for N=5 printing formes 17 or n=5 printed pages, 2.5 ribbons, such as, for example, two ribbons, each two pages in width, and one ribbon which is one page in width, in the format F1 or f1 of a newspaper or tabloid production, can be produced with a printing unit 02 in the embodiment of the first example. For N=3 printing formes 17' or n'=6 printed pages, 3 ribbons, such as, for example, three ribbons, each two pages in width in the format F1 or f1 of a newspaper or tabloid production can be produced with a printing unit 02 in the embodiment of the second example. In the second operating mode II for example, heatset printing, m/2, for example four ribbons, each of two pages in width, of the format F2, for example magazine format F2, such as, for example, 64 pages in DIN A4 format in collect mode, can be produced from one web.

Preferably one printing blanket, such as, for example, a rubber blanket, which extends over the entire usable length L of the cylinder surface, i.e., over the N sections A; B; C; D; E or first printing formes 17; 17', shown in FIG. 3*a* and FIG. 5*a*, or the n or n', for example five, shown in FIG. 3*a*, or six, shown in FIG. 5*a*, newspaper pages, is arranged on the transfer cylinder 06. This one printing blanket can then also extend over nearly the entire cylinder circumference, or can encompass the entire outer surface of the transfer cylinder 06 as a sleeve. In this case, the rubber blanket can be held in a channel and can be tightened by corresponding devices, such as, for example, by double-spindle tensiondevices.

In another advantageous embodiment of the transfer cylinder 06 and one corresponding, in particular, to the embodiment having an even number n' of printed pages on an uneven number N of printing formes 17' in the first operating mode, the transfer cylinder has two rubber blankets arranged side by side, for example, with each such blanket extending over half the usable length of the cylinder surface.

In an embodiment that is advantageous with respect to the necessary channel configuration, the respective rubber blanket is embodied as a metal printing blanket, for example, and specifically is configured as a multilayer rubber blanket with an elastic layer applied to a rigid support plate, such as, for example, a thin metal plate. In this case, a channel having a width of less than 7 mm, and especially having a channel width of less than 5 mm, in the circumferential direction of the transfer cylinder, can be used to hold the ends of the rubber blanket.

For both examples, the forme cylinder 04 has, on its outer surface, at least one continuous opening 19 and extending radially into an inwardly extending channel 20, into which continuous opening 19, angled ends of the printing formes 17; 17'; 18; 18' can be inserted for fastening. The continuous opening 19 extends over the usable length L of the forme cylinder 04 and/or over the width of n or n' printed pages and/or printing formes 17; 17' of the first format F1; f1. If the circumference of the forme cylinder 04 corresponds to two vertical printed pages in the first vertical format F1 or corresponds to four horizontal printed pages in the first horizontal format f1, the forme cylinder 04 can have two such continuous openings 19 leading to two circumferentially spaced channels 20, which are offset from one another by 180° in the circumferential direction of the forme cylinder. In principle, the channels 20 and the printing forme ends could be embodied such that after the printing forme ends are inserted into the channels 20, they are held in place in the channel 20 in a self-locking manner, such as, for example, as a result of frictional contact or of complementary shapes.

For the embodiments which have been described here, however, retaining assemblies 22, that are actuable via actuating devices 21, are preferably provided in the channel 20 or in the channels 20 as will now be described below.

As has been described above, the forme cylinder 04 is embodied with a usable length L, which, in the first example, is embodied for being covered with n, such as, for example, with five printed pages of a first format F1 or f1 arranged side by side, or with the uneven number N, such as, for example, with N=5 of printing formes 17, and in the second example is embodied for being covered with n' printed pages of a first format F1 or f1 or with the uneven number N, such as, for example, with N=3 of printing formes 17'. These n printed pages, or N=n printing formes 17 of the first example, or the N printing formes 17' of the second example, correspond with N of the sections A; B; C; D; E on the surface of the forme cylinder 04 in the longitudinal direction.

These forme cylinder sections A; B; C; D; E need not be outwardly identifiable as such. They can either correspond logically only to the printing forme arrangement, or can additionally be identified by characterizing features, such as by a number of N corresponding crosswise register devices for the printing formes 17; 17', arranged in the forme cylinder 04 or outside of the forme cylinder 04.

On the forme cylinder 04, as represented schematically in FIG. 4 and FIG. 6, and in the example of a forme cylinder 04 having two axially extending, circumferentially spaced openings 19, the ends of the printing formes 17; 17'; 18; 18' can be inserted through the openings 19 into the channels 20, and are held in place by retaining assemblies 22. The retaining assemblies 22 can advantageously be embodied such that when an actuating device 21 is not actuated, a retained condition exists, and when the actuating device 21 is actuated, an opened condition exists. For each forme cylinder section A; B; C; D; E, in this case, for example, for the five forme cylinder sections A; B; C; D; E depicted in FIG. 3*a* and in FIG. 4, and for the three sections A; C; E depicted in FIG. 5*a* and FIG. 6 of the forme cylinder 04, at least one retaining assembly 22 or a group of retaining assemblies 22, each with two retaining assemblies 22, for example, are provided. With the exception of the retaining assemblies 22.*a*; 22.*b* of the center section of the uneven number N of sections A; B; C; D; E, such as, for example, three or five sections, the retaining assemblies 22 can be activated or can be deactivated individually via the actuating devices 21 or, if multiple retaining assemblies 22 are provided for each section A; B; D; E, these multiple retaining assemblies 22 for each section can be activated or can be deactivated together as a group for the respective section A; B; D; E via actuating devices 21, which may, for example, be actuable with pressure medium. Such actuating devices 21 are identified in FIG. 4, for example, as 21.1; 21.2; 21.4 and 21.5, and are identified in FIG. 6 as 21.1, for example; and as 21.5. In the center section C, however, at least two retaining assemblies 22.*a*; 22.*b*, with at least one such retaining assembly being located on each of the sides of the center plane H, can be controlled, and in particular, can be opened, independently of one another via independently actuable actuating devices 21, which are identified as 21.3*a* and 21.3*b*, respectively in FIG. 4 and in FIG. 6, for example. For N sections A; B; C; D; E on the forme cylinder 04, at least N+1 independently controllable retaining assemblies 22 and/or at least N+1 independently actuable actuating devices 21 are thus provided. This enables a separate control of the center section of N sections A; B; C; D; E.

The retaining assembly 22 can be embodied as one or more clamping elements that are movable in the channel 20 and which are controllable via the assigned actuating devices 21. Advantageously, the retaining assemblies 22 are each embodied as being self-locking. When the actuating devices 21 are not actuated, the retaining assemblies are in their retaining or clamping position as a result of prestressing. When the actuating devices 21 are actuated, the retaining assemblies are moved into their opened, plate end releasing position.

The at least two independently actuable actuating devices 21 and/or the at least two retaining assemblies 22 in the channel 20 of the center section C are connected to control arrangements, such as, for example, to a control device, which may be, for example, an electronic control circuit 28 and which control device optionally contains controllable switching elements 24 and/or to a source of power, such as, for example, electric power or pressure medium, such that these actuating devices 21 can be assigned alternatively, in the first operating mode I, to a same group I-3 of retaining assemblies 22*a*; 22*b* to be actuated simultaneously, or in the second operating mode II to two different groups II-1 or II-2, with each such group II-1 or II-2 containing multiple retaining assemblies 22 which are to be actuated simultaneously. In the first operating mode I, the groups I-1 to I-5 can then each be formed, for example, by the one or by the multiple retaining assemblies 22 of the assigned section A; B; C; D; E. In the second operating mode II only two groups II-1 and II-2 can be formed or are formable, for example. The one group II-1 then has retaining assemblies 22 and/or actuating devices 21 lying on only the one side of the center plane H. The other group II-2 has retaining assemblies 22 and/or actuating devices 21 lying on only the other side of the center plane H.

The retaining assemblies 22 or actuating devices 21 which are situated closest to the center plane H are each therefore alternatively either assigned or are assignable, in terms of circuitry, such as, for example, in terms of a switching command, to a retaining assembly 22 or to an actuating device 21 that lies closer to the closest cylinder end surface in the same channel 20, or to a retaining assembly 22 or to an actuating device 21 that lies closer to the farthest cylinder end surface in the same channel 20.

For this purpose, two retaining assemblies 22 of the center section C, which are arranged on different sides of the center plane H, cooperate with different actuating devices 21. In the example of the aforementioned groups II-1; II-2, in the second operating mode II, the activation/deactivation of the one retaining assembly 22.*a* of the center section C can be, or is assigned to the retaining assemblies 22 of the two adjoining outer sections A and B, as seen in FIG. 4, or of the outer section A, as seen in FIG. 6. The other retaining assembly 22.*b* of the center section C can be, or is assigned to the retaining assemblies 22 of the two outer sections D and E, depicted in FIG. 4, or to the outer section E, depicted in FIG. 6, of the other half of the cylinder. The plate locking mechanism, such as, for example, the retaining assembly 22, along with the actuating device 21 for the center section C, is therefore embodied as being divided into several portions, and each of these several portions can be controlled differently for the two operating modes I; II. In the first operating mode I, the retaining assemblies 22 of the center section C are connected in parallel, for example. In the second operating mode, one half of the retaining assemblies 22 and/or the actuating devices 21 of the center section C can be controlled with the retaining assemblies 22 and/or with the actuating devices 21 of the one cylinder half, in the longitudinal direction and the other half of the retaining assemblies 22 and/or the actuating devices 21 can be controlled with the retaining assemblies 22 and/or with the actuating devices 21 of the other cylinder half.

If, in the eccentric sections A; B; D; E, multiple retaining assemblies 22 are provided for each section A; B; C; D; E, for example, these can each be actuable as a group I-1; I-2; I-4; I-5, for example via a shared actuating device 21, such as, for example, via a reversibly deformable hollow element, and especially a tube, that can be pressurized with pressure medium. In the center, divided, section C, however, at least two such independently actuable actuating devices 21, such as, for example, tubes that can be independently pressurized with pressure medium, are provided.

In FIG. 4 and in FIG. 6, an advantageous embodiment for the configuration of the actuating device 21 is represented as a reversibly deformable hollow element 21 that can be pressurized with pressure medium, and especially as tubing that can be pressurized with pressure medium. In this case, for the retaining assemblies 22, or for the groups of retaining assemblies 22 that are assigned to the eccentric sections A; B; D and E, only one actuating device 21 is assigned to each section A; B; D and E. Each such actuating device acts on the one retaining assembly 22 or, as shown here, on the group I-1; I-2; I-4; I-5 of retaining assemblies 22, in this case, two such retaining assemblies, of the relevant section A; B; D; E. If multiple retaining assemblies 22 and multiple actuating devices 21 are provided for each of the groups I-1; I-2; I-4; I-5 of the eccentric sections A; B; D; E, the actuating devices 21 of the same eccentric section A; B; D; E are embodied to be actuable not independently but together, for example. Each of the independently actuable actuating devices 21 of different eccentric sections A; B; D; E and the at least two independently actuable actuating devices 21 of the center section C has its own line section 23 for supplying power which, in this case, is a pressure medium line 23, and which is shown only by way of example in FIG. 4 and FIG. 6. Each such line section 23 extends from individually controllable switching elements 24 which, in this case, are controllable valves 24, and in particular are pneumatic valves 24 and which are characterized as such only by way of example. In principle, it is possible to guide the separate line sections 23 for each of the independently actuable actuating devices 21, or groups of actuating means, through a corresponding number of bushings up to a location just outside of the forme cylinder 04, and only there to provide corresponding stationary switching elements 24. However, it is advantageous for only a single supply line 26 or a maximum of only two supply lines with, for example, one supply line 26 for end surface, leading into the forme cylinder 04 to be provided, for example in the case of pressure medium, via a rotating union. In this case, the switching elements 24 are arranged fixed to the cylinder and are preferably embodied to be controllable from the outside of the cylinder. In this case, the switching elements 24 are controlled, for example, without direct contact, via control elements 27, preferably using a magnetic or an inductive operating principle. These control elements 27, at least for a certain position of the forme cylinder 04, are arranged, for example, in a pattern that complements that of receivers for the switching elements 24 which are fixed to the cylinder. A definite assignment between a specific control element 27 and a receiver of a specific switching element 24 is thus ensured. The control elements 27 receive their signal from an electronic control circuit 28, for example, in which control circuit 28, for example, the grouping of actuating devices 21, which is dependent upon the mode of operation, and thus the grouping of the control elements 27 and/or switching elements 24 which is dependent upon the mode of operation, is carried out or can be performed.

The switching elements 24 can be distributed, as shown, over the forme cylinder 04, such as, for example, at both end surfaces of the forme cylinder 04. However, all of the switching elements 24 may also be arranged in only one end surface area of the forme cylinder 04. In the former case, one supply line 26 can be guided into each of the two sides of the forme cylinder 04, or, as is shown in FIGS. 4 and 6, a single supply line 26 is provided on only one side of the forme cylinder 04. The switching elements 24 on the other side can then be supplied via a separate connecting line.

Devices for use in the accomplishment of partially or fully automatic plate changes can also be provided in the printing unit 02, and can be used in connection with individual plates at least in the first operating mode. For the second operating mode, such as during magazine production, ½-width plates, for example, optionally each using a provided plate loading device, are used.

While preferred embodiments of a printing couple, a printing press and methods for operating a printing couple, in accordance with the present invention, have been set forth fully and completely hereinabove, it will be apparent to one of skill in the art that various changes could be made such as, for example, in the specific press structure, in the type of plate end retaining assemblies and actuating devices and the like without departing from the true spirit and scope of the present invention which is accordingly to be limited only by the following claims.

What is claimed is:

1. A printing couple of a printing press comprising:

a forme cylinder having a longitudinal axis of rotation and having a circumferential surface divided axially into a plurality of printing forme receiving sections, said sections including a center section and at least first and second outer sections;

a forme cylinder center plane extending transversely to said forme cylinder longitudinal axis of rotation, said center plane bisecting said forme cylinder and dividing said forme cylinder circumferential surface center section into a first center section half and a second center section half, said at least first outer section being adjacent said first center section half, said at least second outer section being adjacent said second center section half;

at least one printing forme end receiving channel in said forme cylinder and extending in said longitudinal axial direction of said forme cylinder and radially inwardly from said forme cylinder circumferential surface;

a plurality of printing forme end retaining assemblies spaced axially along said channel and including at least a first center section half retaining assembly, a second center section half retaining assembly, a first outer section retaining assembly and a second outer section retaining assembly;

a separately operable actuating device for each of said retaining assemblies; and actuating device control means usable to selectively operate each of said separately operable actuating devices, said first center section half retaining assembly actuating device, said second center section half retaining assembly actuating device, said at least first outer section retaining assembly actuating device and said at least second outer section retaining assembly actuating device each being operable independently wherein, in a first mode of operation, said first and second center section half retaining assemblies can work together to retain a printing forme placed on said forme center section and in a second mode of operation, each of said first and second center section half retaining assemblies can work with its adjacent one of said first outer section retaining assembly and said second outer section retaining assembly to each retain selected ones of second and third printing formes placed on said forme cylinder circumference and occupying axial positions different from an axial position of said first printing forme.

2. The printing forme couple of claim 1 wherein said forme cylinder has an uneven number of said sections in a direction of said longitudinal axis, with each of said sections being adapted to be covered with a separate printing forme in said first mode of operation.

3. The printing couple of claim 2 wherein in said first operating mode, said first and second center section half retaining assemblies are operable independently by said first and second center section half retaining assembly actuating devices in response to said actuating device control means.

4. The printing couple of claim 1 wherein each said retaining assembly has a clamping position and an open position and further wherein each said actuating device is usable to hold its respective one of said retaining assemblies in its open position.

5. The printing couple of claim 1 wherein each said retaining assembly is switchable between a clamping position and an opened position by its respective one of said actuating devices.

6. The printing couple of claim 1 wherein at least one of said retaining assemblies is located in a channel portion of each said section.

7. The printing couple of claim 1 wherein each said at least first and second outer section retaining assemblies is actuable individually by its one of said actuating devices.

8. The printing couple of claim 1 wherein said forme cylinder has a length in said axial direction which corresponds to an uneven number of said sections of printing pages in a first format arrangement side by side.

9. The printing couple of claim 8 wherein, in said first operating mode, each of said sections is covered by a printing forme adapted to print one printed page of said first format.

10. The printing couple of claim 1 wherein said forme cylinder has a length in said axial direction which corresponds to an even number of printed pages of a first format arranged side by side.

11. The printing couple of claim 1 wherein in said first operating mode each of said sections is covered by a printing forme adapted to print two printed pages of each first format.

12. The printing couple of claim 1 wherein in said second mode of operation, said forme cylinder is covered by an even number of said printing formes of a second format located side by side in said longitudinal direction.

13. The printing couple of claim 1 wherein in said second mode of operation, said forme cylinder is covered with an even number of printing pages of a second format arranged side by side.

14. The printing couple of claim 1 wherein in said second mode of operation, said forme cylinder is covered with two printing formes side by side with each of said two printing formes supporting multiple pages of a second format.

15. The printing couple of claim 1 wherein said channel extends longitudinally over an entire usable surface length of said forme cylinder.

16. The printing couple of claim 1 further including a transfer cylinder adapted to cooperate with said forme cylinder and carrying a printing blanket extending over an entire length of a usable surface of said transfer cylinder.

17. The printing couple of claim 1 further including a transfer cylinder adapted to cooperate with said forme cylinder and carrying two printing blankets each extending over half of a length of a usable surface of said transfer cylinder.

18. The printing couple of claim 1 wherein said at least one channel has a plurality of channel sections, each of said channel sections being of equal length and each channel section having at least one of said retaining assemblies which is actuable independently.

19. The printing couple of claim 1 wherein each said actuating device is a reversibly deformable hollow element adapted to be pressurized with a flowable pressure medium.

20. The printing couple of claim 1 wherein said control means includes an electronic control circuit and actuable switching elements.

21. The printing couple of claim 20 wherein said actuable switching elements are arranged fixedly on said forme cylinder.

22. The printing couple of claim 1 wherein a length of said forme cylinder corresponds to an uneven number of said sections and adapted to hold printing formes arranged side by side in said first operating mode and carrying one of an uneven number and an even number of printed pages of a first format.

23. The printing couple of claim 22 further including a longitudinal cutting device after, in a direction of web travel, said printing couple and having a number of blades movable transverse to travel direction of said web.

24. The printing couple of claim 23 further including a turning device, and having a plurality of turning bars, situated after, in said direction of web travel, said longitudinal cutting device, said turning device being movable with respect to said forme cylinder center plane.

25. The printing couple of claim 24 further including a former assembly located after, in said direction of web travel, said turning device, said former assembly being oriented such that a web feed direction to said former assembly is perpendicular to said forme cylinder center plane.

26. The printing couple of claim 1 further including additional printing couples adapted to work with said printing couple and forming a printing unit.

27. The printing couple of claim 26 wherein said printing unit is supported by separate side frames.

28. The printing couple of claim 26 wherein said printing unit further includes a dryer.

29. The printing couple of claim 1 wherein in said first mode of operation, said printing couple is operable using coldset inks.

30. The printing couple of claim 1 wherein in said second mode of operation, said printing couple is operable using heatset inks and further including a printed web dryer located, after, in a direction of web travel, said printing couple.

31. A printing couple of a printing press comprising:

a forme cylinder having a longitudinal axis of rotation and having a circumferential surface divided axially into an uneven number of printing forme receiving sections and including a center section and at least first and second outer sections spaced from said center surface toward first and second forme cylinder ends respectively;

a forme cylinder center plane extending transversely to said forme cylinder longitudinal axis of rotation, said center plane bisecting said forme cylinder and dividing said center section into a first center section half and a second center section half, said at least first outer section being adjacent said first center section half, said at least second outer section being adjacent said second center section half;

at least one printing forme end receiving channel in said forme cylinder and extending in said longitudinal axial direction of said forme cylinder and radially inwardly from said forme cylinder circumferential surface;

a plurality of printing forme end retaining assemblies spaced axially along said channel and including at least one first center section half retaining assembly a second center section half retaining assembly, a first outer section retaining assembly and a second outer section retaining assembly;

a separately operable actuating device for each of said retaining assemblies; and actuating device control means usable to selectively operate each of said separately operable actuating devices and wherein in a first operating mode each said printing forme receiving section is covered with a printing forme that extends over a length of each said section and wherein in said center section, each of said first center section half retaining assembly actuating device and said second center section half retaining assembly actuating device can be assigned, by said control means, alternatively to the other of said second center section half retaining assembly actuating device and said first center section half retaining assembly actuating device and to said first outer section retaining device actuating assembly and to said second outer section retaining device actuating assembly.

32. The printing couple of claim 31 wherein a number of said retaining assemblies is greater than a number of said forme cylinder sections.

33. A method of operating a printing couple of a printing press including:

providing at least one forme cylinder having a plurality of forme cylinder sections formed on a circumferential surface and including a center section and at least first and second outer sections;

locating said first outer section adjacent said center section and extending toward a first end of said forme cylinder and locating said second outer section adjacent said center section and extending toward a second end of said forme cylinder different from said first end;

supporting said at least one forme cylinder for rotation about a longitudinal forme cylinder axis of rotation;

bisecting said center one of said plurality of forme cylinder sections using a center plane into a first half center section and a second half center section;

providing an axially extending plate end retaining channel extending along a surface of said at least one forme cylinder;

positioning a plurality of printing forme end retaining assemblies spaced axially from each other in said plate end retaining channel;

providing a first actuating device for a first of said retaining assemblies operable with said first half center section;

providing a second actuating device for a second of said retaining assemblies operable with said second half center section;

providing a third actuating device for a third of said retaining assemblies operable with said first outer section;

actuating said first actuating device and said second actuating device, without said third actuating device, in a first operational mode of said forme cylinder; and actuating said first actuating device and said third actuating device, without said second actuating device, in a second mode of operation of said forme cylinder.

34. The method of claim 33 further including providing an uneven number of printing formes on said forme cylinder in said first operating mode and having print images of a first format in a longitudinal direction and providing an even number of printing formes having print images of a second format different from said first format.

* * * * *